United States Patent [19]

Dragone

[11] Patent Number: 4,667,724

[45] Date of Patent: May 26, 1987

[54] FOLDING PARTITION SYSTEM COMPOSED OF A SERIES OF ADJACENT PANELS

[75] Inventor: Vincenzo Dragone, Cattolica, Italy

[73] Assignee: Effe Elle S.p.A., S. Giovanni in Marignano, Italy

[21] Appl. No.: 736,248

[22] Filed: May 21, 1985

[30] Foreign Application Priority Data

Jun. 5, 1984 [IT] Italy ..... 3484 A/84
Mar. 21, 1985 [IT] Italy ..... 3373 A/85

[51] Int. Cl.[4] ..... E06B 3/12

[52] U.S. Cl. ..... 160/229 R; 160/135; 16/355

[58] Field of Search ..... 160/229 R, 135, 232, 160/351; 16/355, 356, 362

[56] References Cited

U.S. PATENT DOCUMENTS

| | | | |
|---|---|---|---|
| 1,554,334 | 9/1925 | Cranshaw et al. | 160/229 R |
| 3,889,315 | 6/1975 | Stouffer | 160/135 X |
| 4,021,973 | 5/1977 | Hegg et al. | 160/351 X |
| 4,344,475 | 8/1982 | Frey | 160/135 |
| 4,446,669 | 5/1984 | Siegal | 160/135 X |
| 4,448,231 | 5/1984 | Salkeld et al. | 160/135 |
| 4,475,268 | 10/1984 | Labelle | 16/355 |

*Primary Examiner*—Ramon O. Ramirez
*Attorney, Agent, or Firm*—Balogh, Osann, Kramer, Dvorak, Genova & Traub

[57] ABSTRACT

The folding partition system disclosed is composed of a series of panels, and incorporates a hinge-post molding located between each two successive panels. A hinged joint created between the panels features on the one hand, two mating surfaces having a profile in the form of an arc of a circle the radii of which converge on a hinge pin, and on the other, two seals which remain in contact with these mating surfaces when the panels are swung on the hinge-posts.

8 Claims, 6 Drawing Figures

FIG 1
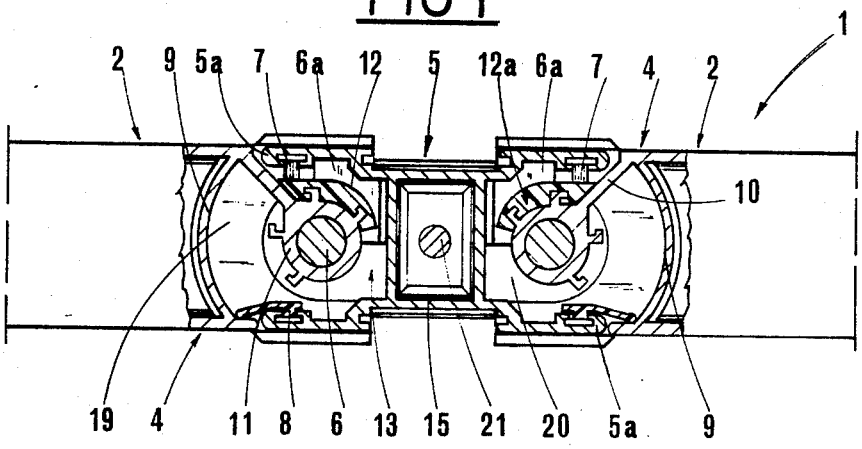
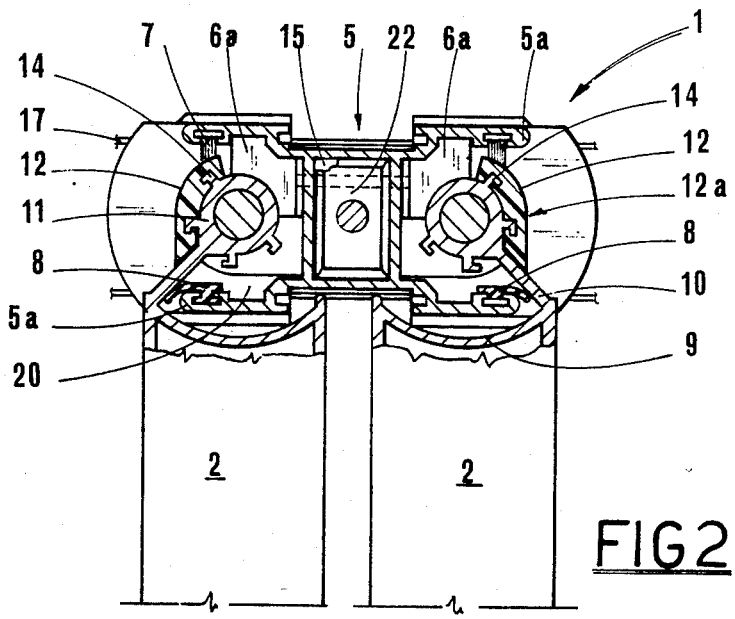
FIG 2

FIG 4b
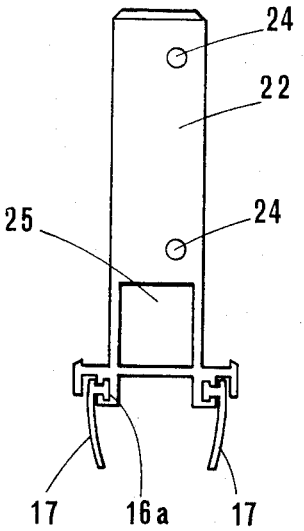
FIG 4a
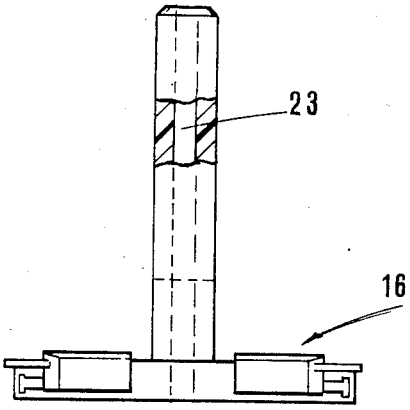
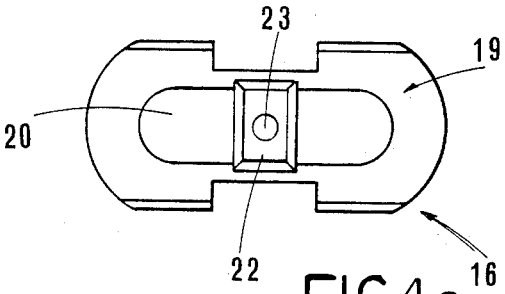
FIG4c
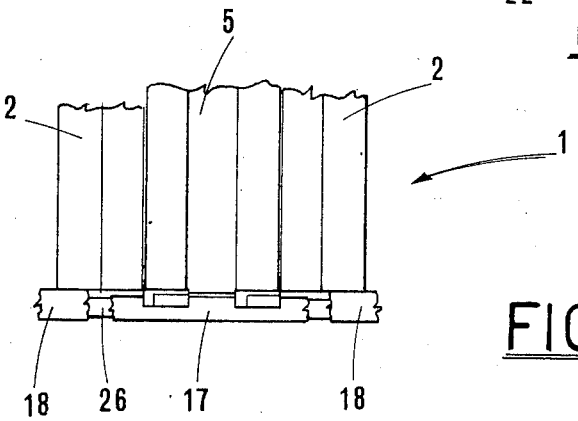
FIG3

FOLDING PARTITION SYSTEM COMPOSED OF A SERIES OF ADJACENT PANELS

BACKGROUND OF THE INVENTION

There are many types of folding partition systems currently available on the market, which systems are designed to glide back and forth between upper and lower horizontal tracks. Such folding partitions are especially useful for closing off and shielding open spaces such as verandas, loggias, balconies, porches and so forth.

Partitions of the type are easily folded down 'concertina'-fashion into a stack, with one panel flat against the other, in such a way as to enable a markedly compact stowage. Folding partitions are also used to considerable advantage for splitting up rooms into smaller units in an infinite variety of ways. The and removal of the single partition is quick and simple.

Folding partition systems are practical and appreciated by the user because of their simplicity of use; they are easily opened out and drawn back, and the advantages already mentioned are undeniable. Nevertheless there are certain drawbacks in existing systems which inhibit the functional characteristics of the folding partition.

A first drawback stems from the fact that such systems are complex and costly. The main disadvantage however is the lack of adequate heat and sound insulation, especially at the fold between adjacent panels...in other words, at the hinges. The panels are joined together by somewhat complex hinge arrangements and in many instances the hinges themselves permit left or right hand opening only, meaning that alternation of left and right hand hinges is required between one panel and the next.

One attempt to create efficient insulation at the gaps between panels involves the use of seals made from rubber or similar material which will flex when the panels are swung on the hinge-posts. Such a remedy fails to provide sufficient insulation at the top and bottom ends of the seal which terminate without making any sort of contact such as will provide a heat-and-soundproof barrier. In addition, it will be clear that continued folding of the partition will produce considerable wear on the seals, and thus jeopardize the effectiveness of the insulation. Lastly, such flexible seals are by no means acceptable from an esthetic standpoint when the panels are folded down and stowed.

The general object of the invention described herein is to provide a folding partition system with features which will eliminate the above drawbacks.

Within the framework of this general object, it is also sought, with the invention, to embody a folding partition composed of a smaller number of parts than currently is the case and to enable utilization of the identical parts at each hinged joint, regardless of left or right hand fold.

Not least among the objects of the invention is that of providing a folding partition which will afford a level of heat and sound insulation at the hinged joints comparable with that afforded by the solid partition panels themselves.

A further object of the invention is that of enabling optimum heat and sound insulation, in like manner, at the top and bottom ends of the seals of the hinge-post molding between successive panels.

SUMMARY of the INVENTION

The invention, as described in the following specification and characterized according to the appended claims, offers the following advantages:

Option of selecting left or right hand fold of the single panels without any need for alternating the hinge-posts; optimum heat and sound insulation provided at all points of the folding partition system; ease of assembly, in view of a limited number of parts designed such that assembly operations are rendered as simple as possible; improvement in the stability and support both of the hinge pins and of the studs which glide back and forth in the tracks.

BRIEF DESCRIPTION of the DRAWINGS

An embodiment of the invention will now be described in detail, by way of example, with the aid of the accompanying drawings, in which:

FIG. 1 is a section, cut away and viewed in plan, through the hinged joint between two adjacent panels of a folding partition system as described herein;

FIG. 2 shows the same hinged joint of FIG. 1, with the two panels swung through 90° from the position initially illustrated;

FIG. 3 is a schematic in which the hinged joint of FIG. 1 is viewed frontally;

FIGS. 4*a*, 4*b* and 4*c* illustrate an accessory of the folding partition system viewed frontally, from the side, and in plan, respectively.

DESCRIPTION of the PREFERRED EMBODIMENT

With reference to the drawings, 1 denotes the assembled folding partition system which is composed substantially of single panels 2 made up from boards or glass panes surrounded by a frame molding 4, with a separate hinge-post molding 5 located between each two successive panels and directly adjacent to either side of the frame molding 4. Each hinge-post molding connects with the panel 2 at either side via means of support 6*a*, to be described in full at a later stage, which supports are disposed vertically and concurrent with the median plane of the extended partition.

The hinge-post molding 5 exhibits what is substantially an "H" profile when seen in plan, and has a hollow center slot 15, likewise described in full at a later stage. The open ends of the "H" are directed toward the panels 2, four leg members incorporate two opposed pairs of seats 5*a* which support retaining respective seals 7 and 8 which extend longitudinally the entire length of the molding 5, i.e. from top to bottom. The seals denoted 7 are brush-type, preferably, whilst those denoted 8 are lip seals, the farthest edges of which project outwardly from the molding 5.

The frame molding 4 is provided with mating surfaces 9 and 12 which exhibit a profile in the form of an arc of a circle whose radii converge on hinge pins 6, and the surfaces are engaged slidingly by the seals 7 and 8 when the panels 2 are swung on the hinge-post molding 5. In practice, the first such mating surface 9 constitutes that outer edge of the upright frame molding 4 which abuts with the hinge-post molding 5, and has a profile in the form of an arc of a circle whose radii converge on the hinge pins 6. An appendage, denoted 10 and departing from one end of the arc, supports a sleeve 11 of essentially cylindrical shape which ensheathes the hinge pin 6 and retains a strip 12*a* which, likewise has a profile in the form of an arc of a circle whose radii converge on the hinge pins 6, constitutes the second mating surface 12, in this instance located internally of the hinge-post molding 5.

Thus, the brush-type seal 7 pairs with the strip 12*a* to provide the second mating surface 12, whilst the lip seal 8 pairs with the first mating surface 9, at either side of the hinge-post.

The strip 12*a* is made fast to the sleeve 11 of each hinge in removable fashion-viz, ribs 14 of appropriate shape located on the periphery of the sleeve 11 enable slotting into place of the strips 12*a*, which are provided with grooves of corresponding shape. The ribs 14 are incorporated so as to cover substantially the entire lateral area of the cylindrical outer surface of the sleeve 11, thereby affording the possibility of positioning the strip 12*a* to best advantage.

In fundamental terms, the upright frame moldings 4 and the hinge-post molding 5 are embodied in such a way as to create a sealed enclosure 13 at each hinge, by incorporation of the seals 7 and 8 and of an accessory which provides insulation at the top and bottom ends of the seals themselves 7 and 8. The enclosure 13 thus created is maintained, regardless of the position of the panel 2, including the fully folded-down position illustrated in FIG. 2.

The aforesaid accessory comprises a fitting 16 which is applied to the top and bottom butt ends of the hinge-post molding 5 in such a way as to create an insulating surface 19 maintained in tight contact with the top or bottom ends of the seals, as well as with the butt ends of the molding 5.

It will be appreciated from FIG. 4*b* that the fitting 16, viewed in cross section relative to the median plane of the panel 2, exhibits a profile matching that of the outer edge of the cross rail frame molding. With the accessory fitted, therefore, one obtains an unbroken seal along the entire length of the top and bottom tracks 26 in which the folding partition glides back and forth. To this end, the fitting 16 incorporates seats 16*a* at either side (FIG. 4*b*) for the retention of corresponding seals 17 which integrate the series of single panel seals 18 into a continuous, unbroken insulating stirp at top and bottom of the partition. Both the seals 17 and 18 are maintained in permanent contact with mating surfaces offered by each track 26. The insulating surface 19 presented by the fitting 16 also offers an opening 20 permitting passage of the studs which form part of the partition's glide mounts, as well as of the bolt (not shown) by way of which panels are locked into position.

The fitting 16 is embodied to have an advantage in form, substantially, of a "T" (see FIG. 4*a*) the vertical shank 22 of which engages in the center slot 15 of the hinge-post molding 5 and is provided with a through vertical hole 23 for guiding the bolt 21 by means of which the panels 2 of the partition are locked into position. The shank 22 is provided with further transverse holes 24, which are likewise provided in the hinge-post molding 5, for receipt of nuts and bolts or similar threaded fasteners which ensure stable fitment of the supports 6*a* which carry the hinge pins 6, likewise of the glide studs. The remaining opening 25 provided in the shank 22 is a transverse opening accommodating the handle of the bolt 21, which is not illustrated, not being central to the disclosure.

The system thus disclosed duly provides an enclosure 13 which, being maintained heat-and-sound-tight by the seals 7 and 8 in conjunction with the accessory, or fitting 16, ensures that a high level of heat and sound insulation will be provided by the folding partition overall, at the panels and at the hinges, as well as at the top and bottom ends of the seals and the top and bottom butt ends of the hinge-post molding 5.

It will be observed, furthermore, that the seals 7 and 8 are subjected to a minimum of flexure, and thus are able to provide long service life; also, that the strips 12a engaged by the brush seals are easily slotted into position and removed, and offer the advantage of low cost when fashioned from plastic material.

What is claimed:

1. Folding partition system composed of a series of adjacent panels, wherein the panels glide back and forth in tracks, comprising a separate hinge-post molding located between two successive panels, each hinge-post molding being provided with a hinge pin, each hinge-post molding having a pair of separably disposed mating surfaces, each mating surface being in the form of an arc of a circle having radii converging on said hinge pin, a pair of seals, each seal establishing a sliding contact with a respective mating surface in all positions, a panel movement with respect to said hinge pin, said mating surfaces and seals extending over the entire length of said hinge-post molding to provide a heat and sound-tight enclosure adjoining said hinge pin.

2. Folding partition system as in claim 1, wherein each separate hinge-post molding exhibits an "H"-shaped section, the "H"-shaped section having four members which support two opposed pairs of said seals.

3. Folding partition system as in claim 1, wherein the mating surfaces form a part of the panel, and comprise a first mating surface which constitutes an outer edge of an upright frame which abuts with the hinge-post molding, and a second mating surface carried by an appendage which departs from one end of the first mating surface and extends toward the hinge pin.

4. Folding partition system as in claim 3, wherein the second mating surface takes the form of a strip retained by a substantially cylindrical sleeve which ensheathes the hinge pin and is integral with the appendage.

5. Folding partition system as in claim 4, wherein the strip is made fast to the sleeve in a removable fashion, employing a sliding engagement between ribs and corresponding grooves located on the sleeve and on the strip.

6. Folding partition system as in claim 5, wherein the ribs occupy substantially the entire lateral area of the cylindrical outer surface of the sleeve, thereby affording the possibility of positioning a strip to best advantage.

7. Folding partition system as in claim 1, including an accessory featuring a fitting which is applied to the top and bottom butt end of the hinge-post molding, and which, viewed in cross section relative to the median plane of the panel, exhibits a profile matching that of the outer edge of the panel cross rail frame molding and incorporates seats at eitherside for the retention of corresponding seals which integrate the series of single panel seals into a continuous, unbroken insulating strip at the top and bottom of the partition, the seal of the fitting and of the panels being maintained in permanent contact with mating surfaces offered by each track, and in that the fitting exhibits an insulating surface maintained in tight contact with the top and bottom ends of the seals, as well as with the butt ends of the molding, and affording an opening which permits passage of the studs which form part of the partition's glide mounts, as well as to the bolt by way of which panels are locked into position.

8. Folding partition system as in claim 7, wherein the fitting, viewed frontally, is embodied in the form, substantially, of a "T" the vertical shank of which engages in center slot of the hinge-post molding and is provided with a through vertical hole guiding the bolt by means of which the panels of the partition are locked into position, and with further transverse holes likewise provided in the hinge-post molding, for receipt of fasteners for the supports which carry the hinge pins and the glide studs, and with a transverse opening likewise provided in the hinge-post molding for accommodation of the handle of the bolt by means of which the panels of the partition are locked into position.

* * * * *